United States Patent [19]

Seaborn et al.

[11] Patent Number: 4,903,914

[45] Date of Patent: Feb. 27, 1990

[54] WARPING YARN ACCUMULATOR

[75] Inventors: Douglas K. Seaborn, Rte. 3, Box 809T, Cantonment, Fla. 32533; Louis B. Williams, Jr., Milton, Fla.

[73] Assignee: Douglas K. Seaborn, Cantonment, Fla.

[21] Appl. No.: 367,122

[22] Filed: Jun. 16, 1989

Related U.S. Application Data

[63] Continuation-in-part of Ser. No. 273,733, Nov. 14, 1988, abandoned, which is a continuation of Ser. No. 642,456, Aug. 20, 1984, abandoned.

[51] Int. Cl.[4] ..... B65H 59/10; B65H 59/36

[52] U.S. Cl. ..... 242/147 M; 28/190; 28/194

[58] Field of Search ..... 242/147 M, 147 R, 148, 242/149, 150 R, 150 M, 151, 152, 152.1, 153, 154, 155 R, 155 M; 28/185, 186, 187, 188, 189, 190, 194

[56] References Cited

U.S. PATENT DOCUMENTS

| | | | |
|---|---|---|---|
| 2,542,097 | 2/1951 | Shaffer et al. | 242/154 X |
| 3,351,296 | 11/1967 | Frei | 242/147 M X |
| 4,407,767 | 10/1983 | Seaborn | 242/147 M X |

*Primary Examiner*—Stanley N. Gilreath
*Attorney, Agent, or Firm*—Kelly O. Corley

[57] ABSTRACT

In an accumulator in a warping process, a plurality of tension sensors are mounted on a common support member such that adjustment of the support member simultaneously adjusts the release tension of all the tension sensors.

1 Claim, 1 Drawing Sheet

WARPING YARN ACCUMULATOR

This is a continuation-in-part of application Ser. No. 273,733, filed Nov. 14, 1988, now abandoned, which in turn was a continuation of application Ser. No. 642,456, filed Aug. 20, 1984, now abandoned.

The invention relates to the art of warping a weftless warp sheet of yarns onto a beam. More particularly it relates to adjusting or selecting the release tensions on the yarns being so processed.

It is conventional in the textile industry to form a weftless warp sheet of parallel yarns and to wind the warp sheet onto a large spool called a beam. The process is variously referred to as warping or beaming. The warp sheets commonly comprise hundreds or thousands of individual yarns, and are unwound from the beams to feed looms, warp knitting machines, and the like.

The source of warp yarns which are to be beamed is typically a creel supporting a yarn package for each yarn in the warp sheet. The individual yarns are withdrawn from the packages and fed through an arrangement of guides to form the warp sheet.

It is known to feed the warp sheet through an accumulator comprising a tension detector or sensor for each yarn between the creel and the beam, as disclosed in Seaborn U.S. Pat. No. 4,407,767, the disclosure of which is incorporated herein by reference.

When changing the warping process to handle different yarns, all known prior beaming operations using tension sensors have required individual adjustment or replacement of each of the large number of separate tension sensors, which as noted above could number in the hundreds or thousands. This made changing the warping process time-consuming and expensive, and afforded many opportunities for accidental misadjustment of one or more of the numerous tension sensors.

According to the present invention, provision is made for simultaneous adjustment of the release tension of a plurality of the yarns in the warp sheet, thus reducing direct adjustment labor costs, affording an increase in productivity due to reduced time required to place the warping operation back in service, and substantially eliminating misadjustment of the tension sensors.

According to a principal aspect of the invention, this is accomplished by provision of a yarn accumulator for continuously storing a quantity of each of a plurality of yarns in a running weftless warp sheet, the accumulator comprising sensing means, responsive to occurrence of tension in any given one of the yarns equal to a predetermined release level, for releasing the stored quantity of the given one yarn whereby the tension in the given one yarn does not exceed the predetermined release level. The sensing means comprises a like plurality of sensors, each of the sensors comprising a finger associated with a corresponding one of the yarns for engaging and normally holding its associated yarn in a running bight constituting the stored quantity, each finger being pivotally mounted on a common axis for movement between a normal position wherein the finger restrains its associated yarn against the normal running tension of associated yarn and a release position wherein the finger releases the bight upon occurrence of the predetermined release level in its associated yarn. The invention further comprises adjusting means for selectively adjusting the sensing means whereby the predetermined release level is simultaneously adjusted for all of the yarns, the adjusting means comprising a support member extending substantially parallel to and at a given distance from the axis, the member being adjacent to each of the sensors, and means providing a magnetic coupling between the support member and each of the sensors when the fingers are in the normal position, the strength of the magnetic coupling being substantially the same for each of the sensors and being selected to maintain the fingers in the normal position against the normal running tension and to release any of the fingers upon occurrence of the predetermined release level in its associated yarn, and means for selectively adjusting the given distance and for aligning the support member substantially parallel to the axis, whereby the predetermined release level is simultaneously adjusted for all of the sensors.

Other aspects of the invention will in part appear hereinafter and will in part be obvious from the following detailed description taken in connection with the accompanying drawings, wherein.

Figure 1:
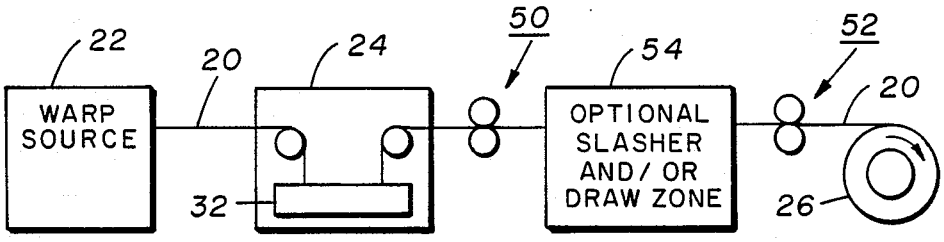
FIG. 1 is a schematic diagram of a warping or beaming operation in which the invention may be used.

As illustrated in FIG. 1, in the general process of warping or beaming, warp sheet 20 composed of a plurality of individual yarns is fed from warp source 22 through tension detector 24, is optionally drawn and/or slashed, and is subsequently wound on beam 26. Warp source 22 will ordinarily be a creel supporting a corresponding plurality of yarn packages. Tension detector 24 generates a signal when the tension in any of the yarns equals a predetermined non-zero level, and the process is stopped in response to the signal. The predetermined non-zero tension level is selected to be low enough that the process stops before the tension in the yarn rises high enough to damage the yarn.

Figure 2:
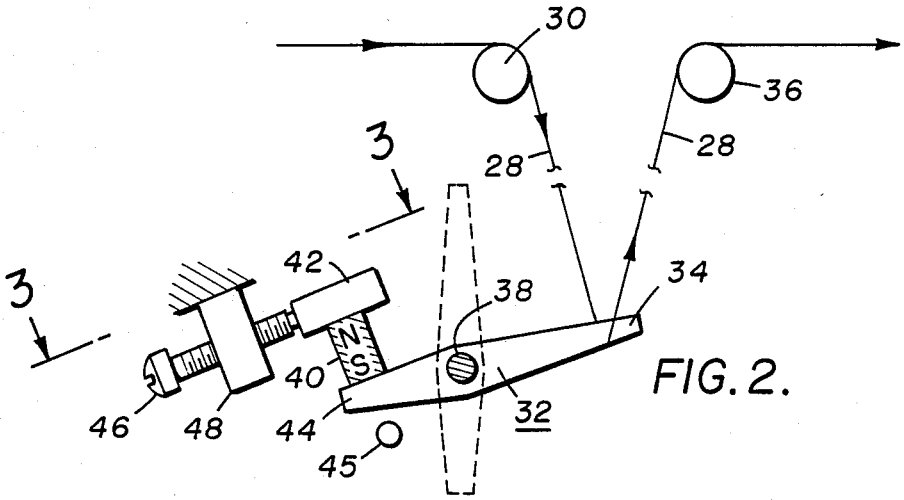
FIG. 2 is a side elevation view, partly in section, of the preferred form of individual yarn tension sensor and yarn release according to a specific aspect of the invention.

Tension detector 24 preferably comprises a sensor 32 for each yarn 28, the particularly preferred form of sensor 32 being illustrated in FIG. 2. Each individual yarn 28 passes over stationary bar 30 and loops downwardly under horizontal finger 34 of its associated sensor 32, then upwardly and over roll 36 before proceeding to further process steps. Ferromagnetic sensor 32 is pivotally mounted on horizontal shaft 38 and is normally maintained in an approximately horizontal position by permanent magnet 40 rigidly mounted on movable support 42 and cooperating with tail 44 on sensor 32. Yarn 28 thus forms a running bight in detector 24 whereby the quantity of yarn in the bight is continuously stored. Detector 24 accordingly comprises a yarn accumulator for temporarily and continuously storing a quantity of each yarn constituting the warp sheet.

In operation, sensor 32 is normally maintained in the horizontal position illustrated in solid lines in FIG. 2 by magnet 40. If yarn 20 snags or otherwise encounters excessive resistance in warp source 22, the tension in the yarn will increase from the normal running tension to some level predetermined by the strength of magnet 40 and by the distance from magnet 40 to shaft 38 as compared to the distance from shaft 38 to the point on finger 34 contacted by yarn 28. When this predetermined level of tension is exceeded, the magnetic coupling or force is overcome and sensor 32 pivots counterclockwise as viewed in FIG. 2. As sensor 32 pivots toward the position indicated in dotted lines, it interrupts a horizontal beam of light perpendicular to the plane of the drawing and directed onto photocell 45. Interruption of the light beam generates a signal which, by conventional control circuitry, stops the process before tension becomes high enough to damage the snagged yarn.

It is essential that tension detector 24 comprise a yarn accumulator, since release of the stored quantity of yarn prevents yarn tension from exceeding the desired level if the process is stopped before the stored quantity of yarn is exhausted. The stored quantity of yarn is accordingly selected with respect to the process speed and inertia so as to be large enough to compensate for the time required to stop the process.

The predetermined level of tension required to actuate finger 34 and thus release yarn 28 can be readily adjusted, according to another aspect of the invention. Screw 46 is threaded through stationary frame member 48 and engages support 42, such that by adjustment of screw 46 the distance between magnet 40 and pivot 38 can be adjusted. Movement of magnet 40 further from pivot 38 increases the required yarn tension. Elements 32 together with elements 40, 42, 46, and 48 accordingly constitute adjustable means, responsive to occurrence of tension in any given one of the yarns equal to a given level, for releasing the stored quantity of the given yarn so that tension in the given yarn does not exceed the desired predetermined level.

According to the Seaborn patent noted above, the process may comprise the step of drawing the warp sheet after it leaves tension detector 24 and preferably before it is wound on beam 26, although the step of drawing could be done while transferring the warp sheet from beam 26 to another beam. As illustrated in FIG. 1, warp sheet 20 passes through nip rolls 50 running at a given speed prior to passing through nip rolls 52. Drawing of the entire warp is accomplished by running nip rolls 52 at a higher speed than nip rolls 50, the respective speeds being selected to provide the desired draw ratio.

In the case of spun (less than fully oriented) yarns made from polyethylene terephthalate, draw zone 54 preferably comprises means for heating the entire warp sheet to a temperature high enough to cause crystallization of the yarn. A temperature of about 100 degrees C. is normally sufficient. For nylon 6 and nylon 66, a heater is not normally required.

In addition to the step of drawing the warp sheet, the warp sheet may be slashed after leaving tension detector 24 and before being wound on beam 26. That is, the running warp is passed through a bath of sizing material such as, for example, polyacrylic acid. The warp sheet is then dried as part of the slashing step before the warp sheet is wound on beam 26. The yarns may be separated before drying (referred to as a "wet split") or they may be dried in contact with one another and then separated (referred to as a "dry split"). The latter procedure is recommended only if the individual yarns have a sufficient amount of twist to prevent filaments from one yarn from being transfered to a different yarn during the splitting step.

The drawing step can be performed in the slasher, as by running the customary quetsch rolls (which squeeze excess liquid from the warp) slower than the slasher output rolls by the desired draw ratio. A wet split is preferred in this embodiment because undrawn yarns ordinarily have insufficient twist to prevent filaments from transferring from one yarn to another when using a dry split.

The apparatus as thus far specifically described with reference to the drawings is the same as that of the Seaborn patent noted above, which is the preferred environment for practice of the present invention. The invention is however not limited to use in this environment with spun yarns as defined in the Seaborn patent, nor to a beaming operation wherein the yarns are drawn and/or slashed prior to being wound on the beam, but may be used with any yarns (including fully drawn yarns) being transferred from a creel to a beam.

Figure 3:
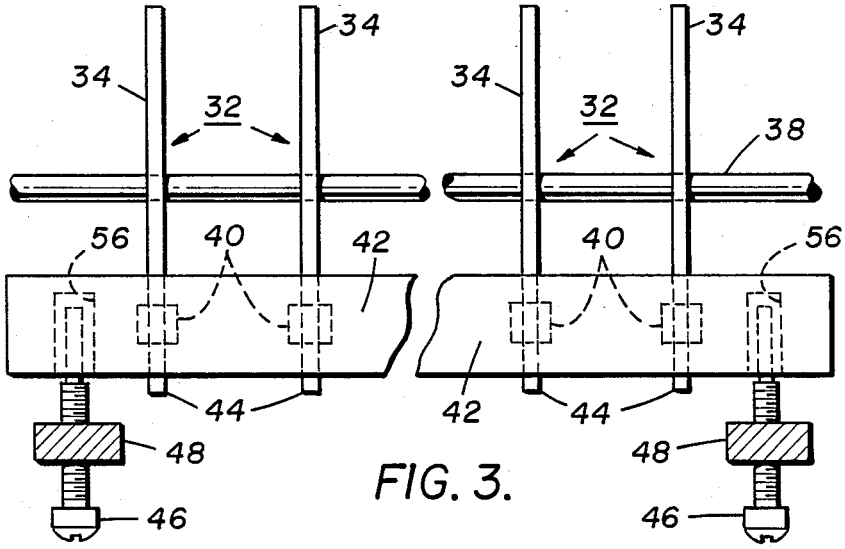
FIG. 3 is a sectional view along line 3—3 in FIG. 2, illustrating the present invention as employed with the FIG. 2 tension sensor.

According to the invention and as illustrated in FIG. 3, provision is made for simultaneous adjustment of many (preferably all) of the individual yarn tension sensors so that the tension level required to release the individual yarns may be rapidly and economically made, with greater assurance of accuracy that was afforded in the prior art. Referring to FIG. 3, a number of individual yarn tension sensors 32 are pivotally mounted on a common or shared shaft 38, which thus provides a common axis about which sensors 32 pivot. Sensors 32 accordingly pivot in parallel arcs when moving from the normal position shown in solid lines in FIG. 2 to the release position shown in dotted lines in FIG. 2.

Referring again to FIG. 3, a common or shared support 42 extends transversely across the apparatus parallel to and at a given distance from shaft 38 and adjacent to each of fingers 34. Means are provided for producing a magnetic coupling between support 42 and each of fingers 34 when fingers 34 are in the normal position, the strength of the magnetic coupling being substantially the same for each of fingers 34 and being selected to maintain fingers 34 in the normal position against the normal running tension and to release any of fingers 34 upon occurrence of the predetermined or release tension of its associated yarn. To this end, support 42 supports a plurality of magnets 40, there being a magnet 40 for cooperating with tail 44 of each sensor 32. If desired, the plurality of individual magnets 40 may be replaced with a single elongated magnet extending beneath and along the length of support 42. Right circularly cylindrical recesses 56 are provided in each end of support 42 for journalling (rotatably receiving) the ends of parallel screws 46, such that support 42 is in turn supported by screws 46. If desired or expedient, there may be provided further or alternative non-illustrated guide means for guiding and stabilizing support means 42 for movement generally parallel to the axes of and under the control of screws 46.

Shared or common support 42 and magnets (or single elongated magnet) 40, in cooperation with screws 46 and frame member 48, constitute adjusting means for selectively adjusting the adjustable means so that the predetermined yarn tension level (the release tension) is simultaneously adjusted for all of the yarns.

In use of the invention to change the yarn tension level to a new value, screws 46 are turned appropriately to change the distance between support member 42 and the axis of shaft 38 while maintaining parallelism therebetween. This may be simply done by adjusting support member 42 until the tension required to release the rightmost and leftmost sensors 32 (as viewed in FIG. 3) from their associated magnet or magnets is at the desired level. This automatically and simultaneously sets all of the remaining of intermediate sensors 32 to release their associated yarns at the same tension level. Accidental erroneous adjustment of the intermediate sensors is thus avoided with great savings in labor cost, and productivity of the beaming apparatus is enhanced by the reduction in time required for the adjustment.

Adjustment of the release tension by movement of the magnet or magnets 40 does not substantially affect the normal running tension of the various yarns.

We claim:

1. A yarn accumulator for continuously storing a quantity of each of a plurality of yarns in a running weftless warp sheet, each of said yarns having a normal running tension, said accumulator comprising:

(a) sensing means, responsive to occurrence of tension in any given one of said yarns equal to a predetermined level, for releasing the stored quantity of said given one yarn whereby the tension in said given one yarn does not exceed said predetermined level, said sensing means comprising a like plurality of sensors, each of said sensors comprising a finger associated with a corresponding one of said yarns for engaging and normally holding its said associated yarn in a running bight constituting said stored quantity, each said finger being pivotally mounted on a common axis for movement between:

(1) a normal position wherein said finger restrains its said associated yarn against the normal running tension of said associated yarn, and (2) a release position wherein said finger releases said bight upon occurrence of said predetermined level of tension in its said associated yarn; and (b) adjusting means for selectively adjusting said sensing means whereby said predetermined level of tension is simultaneously adjusted for all of said yarns, said adjusting means comprising:

(1) a support member extending substantially parallel to and at a given distance from said axis, said member being adjacent to each of said sensors, (2) means providing a magnetic coupling between said support member and each of said sensors when said fingers are in said normal position, the strength of said magnetic coupling being substantially the same for each of said sensors and being selected to maintain said fingers in said normal position against said normal running tension and to release any of said fingers upon occurrence of said predetermined level of tension in its said associated yarn, and (3) adjusting means for selectively adjusting said given distance and for aligning said support member substantially parallel to said axis, whereby said predetermined level of tension is simultaneously adjusted for all of said sensors.

* * * * *